US005247767A

United States Patent [19]

Hadgis

[11] Patent Number: 5,247,767

[45] Date of Patent: Sep. 28, 1993

[54] NON-DIRECTIONAL BUFFING WHEEL

[75] Inventor: John S. Hadgis, Hinckley, Ohio

[73] Assignee: Areway, Inc., Brooklyn, Ohio

[21] Appl. No.: 719,967

[22] Filed: Jun. 24, 1991

[51] Int. Cl.[5] ..... B24D 11/00

[52] U.S. Cl. ..... 51/400; 15/230.14; 15/230.15; 51/394

[58] Field of Search ..... 51/330, 331, 332, 358, 51/364, 372, 375, 388, 394, 400, 401; 15/230, 230.14, 230.15, 230.16, 230.17

[56] References Cited

U.S. PATENT DOCUMENTS

| | | | |
|---|---|---|---|
| 981,841 | 1/1911 | Codman | 15/230.14 |
| 2,146,284 | 2/1939 | Churchill | 15/230.14 |
| 2,442,107 | 5/1948 | Wallich | 51/401 |
| 2,687,602 | 8/1954 | Churchill | 15/230.14 |
| 2,803,096 | 8/1957 | Mockiewicz | 15/230.14 |
| 3,120,724 | 2/1964 | Mockiewicz | 51/358 |
| 3,566,551 | 3/1971 | Hall | 51/394 |
| 3,822,517 | 7/1974 | Moss | 51/394 |
| 4,799,338 | 1/1989 | Schaffner | 51/358 |

*Primary Examiner*—Bruce M. Kisluk
*Assistant Examiner*—Bo Bounkong
*Attorney, Agent, or Firm*—Renner, Otto, Boisselle & Sklar

[57] ABSTRACT

Non-directional buffing wheel includes plural pairs of buff fingers mounted in circumferentially spaced relation around an annular support. Each of the buff fingers is made of plural plies of folded fabric having completely closed oppositely facing side edges, whereby the buffing wheel may be rotated in either direction for buffing a workpiece. In use, one or more of these buffing wheels may be rotated against a workpiece in either direction, and then rotated against the workpiece in the opposite direction. Also, the workpiece may be rotated in the opposite direction of the buffing wheel or in the same direction as desired.

13 Claims, 4 Drawing Sheets

NON-DIRECTIONAL BUFFING WHEEL

BACKGROUND OF THE INVENTION

This invention generally relates to a non-directional buffing wheel which is designed to be rotated in either direction for either cut buffing or color buffing a workpiece. Also, the invention relates to a method of using such a buff to both cut buff and color buff workpieces.

Buffs particularly designed for both cut buffing and color buffing the external surfaces of workpieces such as vehicle wheels and the like have been employed for some time. Of the different types of buffs previously available, finger buffs have been found to be most useful for buffing such wheels. Heretofore, the individual fingers were typically made by folding one or more layers of a lengthy strip of cloth repeatedly along its longitudinal length until the number of plies and width of the desired fingers were obtained. The folding resulted in a strip which was closed along one side edge thereof and open along the other side edge. The folded strip was then sewed in a number of parallel rows along its length to maintain the folds, cut into segments, and folded in half across their widths to provide pairs of side-by-side fingers slightly longer than the desired final finger length in the buffs. A plurality of such segments were then secured in a steel hub such as a cinch ring adapted to be driven for rotation. In the past, the closed side edge of each finger was laid in the same direction around the buff and the open side edge laid in the opposite direction thus making a directional buff that could only be run with the closed side edge of each finger pointing in the direction of rotation of the buff.

SUMMARY OF THE INVENTION

The present invention provides a finger buff having a plurality of buff fingers which are closed at both external side edges thereof, whereby regardless of the direction of rotation of the buff, a closed external side edge of each finger faces toward the intended direction of rotation of the buff.

The method of folding the buff fingers according to this invention involves first folding the side edges of one or more layers of strip material toward the middle and then folding the initial folds again toward the middle such that one of the initial folds directly overlies all of the material side edges and the other initial fold substantially abuts the one initial fold to provide a substantially flat planar inner surface on one side of the strip material which is only interrupted where the initial folds meet and a substantially flat planar outer surface on the other side of the material which has no interruptions. The material is then stitched with at least two rows of stitching passing through the folded material extending from the one initial fold overlying the material side edges on opposite sides thereof and at least one row of stitching passing through the folded material extending from the other initial fold, whereby all of the side edges of the strip material lie completely encompassed within the outer periphery of the folded material. Thereafter, the material is cut into segments having a length slightly greater than the length of two fingers and folded intermediate their length prior to inserting into a cinch ring or the like.

In accordance with another aspect of the invention, the segments are folded so that the planar faces with the opposed folds intermediate the length thereof face inwardly toward each other and the planar faces without any folds or interruptions face outwardly away from each other. The folded segments are then secured in a cinch ring or the like to provide a complete finger buff having pairs of fingers around the periphery of the ring.

Further in accordance with the invention, one or more such finger buffs may be mounted on an arbor and rotated against a workpiece in either rotational direction to buff the workpiece.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
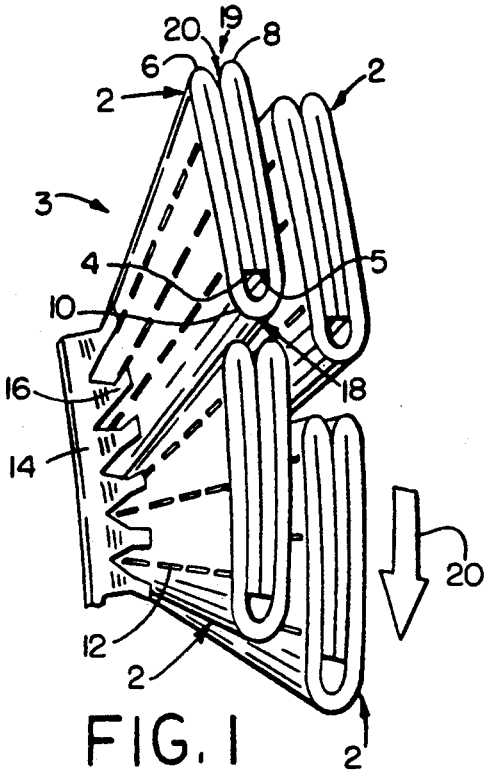
FIG. 1 is a schematic fragmentary perspective view of two pairs of fingers of a conventional finger buff.

Referring now in detail to the drawings, and initially to FIG. 1, there are illustrated two pairs of buff fingers 2 of a conventional finger buff 3. Each pair of buff fingers 2 is generally formed out of several layers of a lengthy strip of cloth-like material that are successively folded in half along their length until the number of plies and widths desired for each pair of fingers is obtained. Alternatively, and as illustrated in FIG. 1, the cut edges 4 and 5 of the several fabric layers are first folded at 6 and 8 toward the middle and then further folded at the middle 10 to cause the first folded sides to overlie each other in such a manner that the free or bias cut edges 4 and 5 are inside the fingers 2.

When sisal is used to make the fingers 2, the sisal is usually sandwiched between cloth. After folding, the plies are sewn together by a plurality of rows of stitching 12 and cut into segments having lengths somewhat greater than twice the length of the final fingers 2 in the buff 3. This allows the segments to be folded in half widthwise to form two side-by-side fingers 2 and the fold inserted into a cinch ring 14 and held in place by cinch ring teeth 16. In practice, the resulting disc shaped buff 3 is secured for rotation on an arbor as by means of two arbor carried flanges (not shown), the periphery of which come to approximately the edge of the metal teeth 16 of the cinch ring 14.

Note that in the prior finger buff 3 illustrated in FIG. 1, each of the fingers 2 has a single fold 10 at one side edge 18 and two folds 6 and 8 at the other side edge 19 defining an opening 20 therebetween. Accordingly, all of the fingers 2 must be oriented in the same direction around the buff 3 thus making a directional buff that can only be driven with the single folds 10 along the side edge 18 pointing in the direction of rotation as is illustrated by arrow 20. If driven in the opposite direction, the opening 20 between the two folds 6 and 8 along the other side edge 19 could catch on the workpiece and either tear the workpiece from the fixture in which it is mounted or tear the buff itself causing the buff to prematurely wear out.

Figure 2:
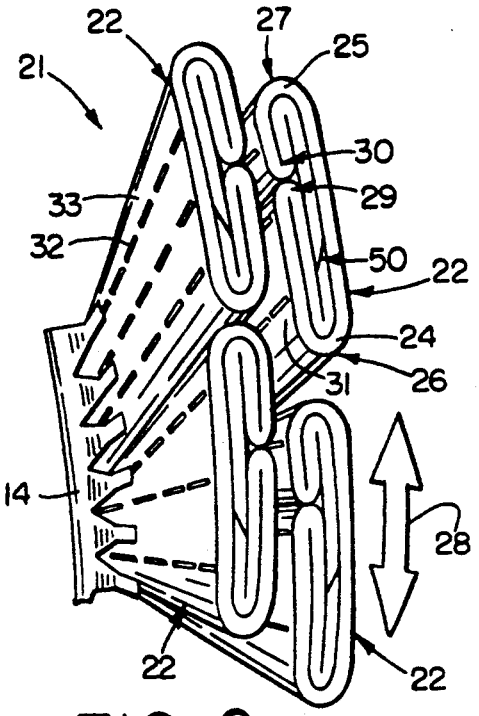
FIG. 2 is a schematic fragmentary perspective view of two pairs of fingers of a preferred form of finger buff according to the present invention.

In contrast, as is illuminated in FIG. 2, a finger buff 21 made according to this invention includes fingers 22 which are folded in such a way as to provide a single exterior fold 24, 25 at each side edge 26, 27. With this configuration, the finger buff 21 may be rotated in either direction as is illustrated by arrow 28 in FIG. 2, since both side edges 26, 27 are completely closed by the single folds 24, 25 and have no exterior tails or openings such as formed by the two folds 6 and 8 of the prior known buff 3 shown in FIG. 1. One or more buffs 21 of the instant invention thus can be placed on an arbor without regard to the direction of rotation, and can be driven in either direction without adversely affecting the life of the buffs or otherwise creating a dangerous situation.

Figure 3:
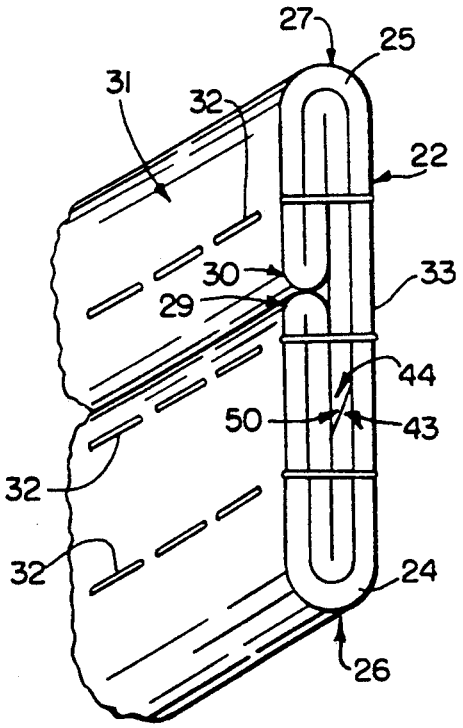
FIG. 3 is an enlarged schematic fragmentary perspective view of the axial outer end of one of the buff fingers of FIG. 2.

With reference now to FIG. 3, an enlarged fragmentary view of the axial outer end of one of the righthandmost buff fingers 22 of FIG. 2 is shown to more clearly illustrate the single external folds 24, 25 at each side edge 26, 27 of the finger which permit the finger to be rotated in either direction after the finger buff 21 has been mounted on an arbor. It will also be seen from FIG. 3 that each finger 22 has two other external folds 29, 30 facing each other intermediate the width of the inner face 31 of each finger.

Figure 4:
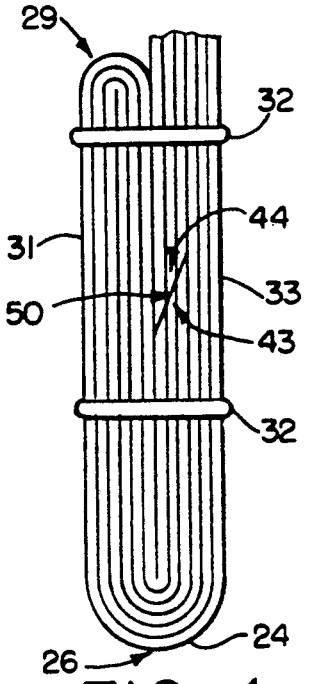
FIG. 4 is a further enlarged schematic fragmentary cross sectional view through the bottom portion of the buff finger of FIG. 3.

Each finger 22 is stitched and shirred, as is readily seen in FIGS. 3 and 4, with a plurality of rows of stitching 32. The stitching rows 32 pass from the inner face 31 to the outer face 33 to hold in place the layers of material from which the finger is made. When the finger is sewn, the folds 29 and 30 are linearly aligned and opposed such that inner face 31 is substantially flat and planar. The outer face 33 is also substantially flat and planar, but without any folds or other interruptions across the width thereof.

Figure 5:
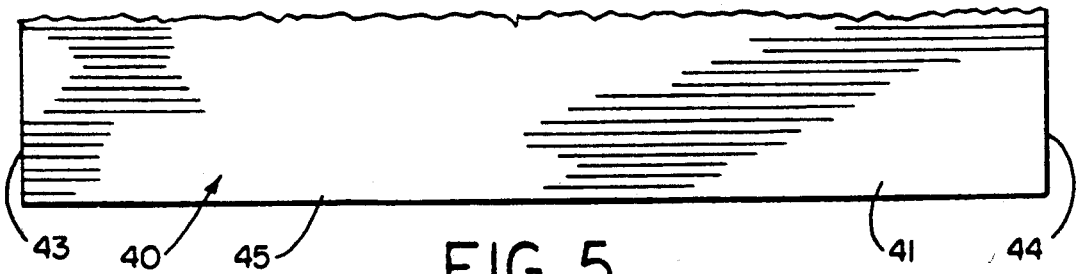
FIGS. 5–14 are schematic illustrations showing the procedure for making each of the buff fingers of FIGS. 2–4.
Figure 6:
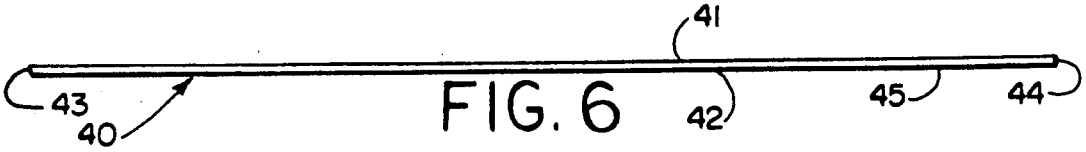

Referring now to FIGS. 5–14, a preferred method of making each pair of buff fingers 22 according to this invention is illustrated. The fingers are made from an elongated piece of material 40 having top and bottom faces 41, 42 and opposite cut side edges 43, 44. Running between the material cut side edges 43, 44 are cut end edges 45 (FIGS. 5 and 6).

Figure 7:
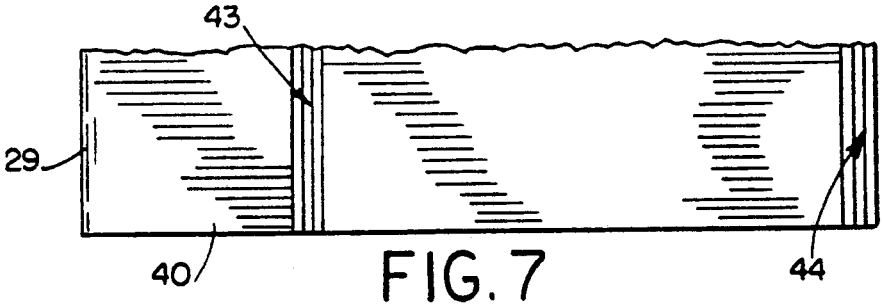
Figure 8:
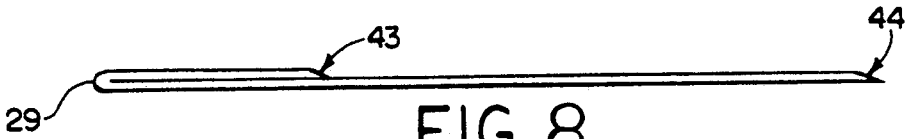
Figure 9:
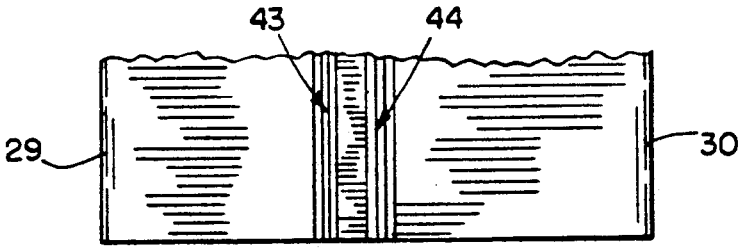
Figure 10:
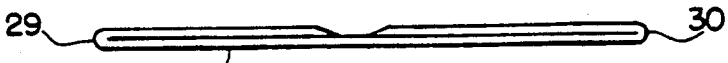
Figure 11:
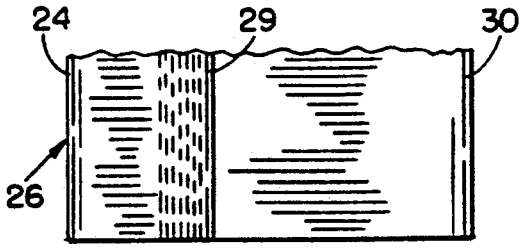
Figure 13:
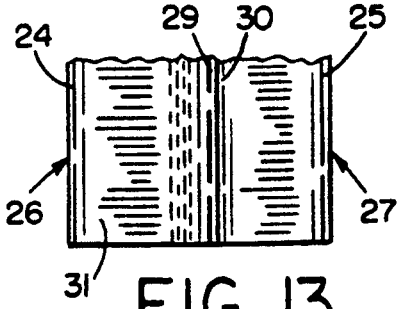
Figure 12:
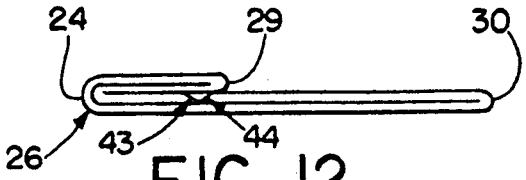
Figure 14:
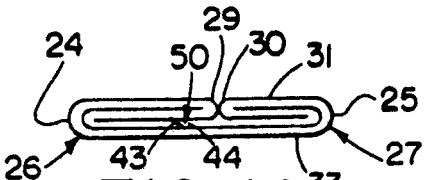

As is illustrated in FIG. 7, plural layers of the material 40 may be provided, for example, three layers as shown, stacked one on top of another. In forming the fingers, the opposite cut side edges 43, 44 are folded toward the middle so that they overlie a portion of the top face 41, thereby creating first and second folds 29 and 30 (FIGS. 7–10).

The plural layers of strip material 40 are then folded again from the first and second folds 29 and 30 toward the middle (FIGS. 11–14) such that one of the folds 29 directly overlies all of the material cut side edges 43, 44 and the other fold 30 substantially abuts the fold 29 to provide the substantially flat, planar inner surface 31, with additional single exterior folds 24, 25 along opposite side edges 26, 27. Opposite the inner surface 31 is the outer surface 33 which is also substantially flat and planar like the inner surface 31, but without the slight interruption on the inner surface 31 formed by the abutted folds 29, 30. The material is then stitched with at least two rows of stitching 32 passing through the folded material extending from the folded side edge 26 on opposite sides of the material cut side edges 43 and 44 and at least one row of stitching 32 passing through the folded material extending from the folded side edge 27 (see FIG. 3). It will be seen that all of the cut side edges 43, 44 of the material now lie completely encompassed within the outer periphery of the folded finger 22 as is indicated at 50 in FIGS. 3, 4 and 14.

Thereafter, the material is cut to a length slightly longer than the length of two fingers 22, and folded at 52 (FIG. 16) intermediate its length prior to inserting in a cinch ring 14. During folding, the segments are folded so that the planar faces 31 with the opposed folds 29 and 30 intermediate their length face inwardly toward each other and the completely uninterrupted planar faces 33 without the folds face outwardly away from each other as seen in FIG. 2.

Figure 15:
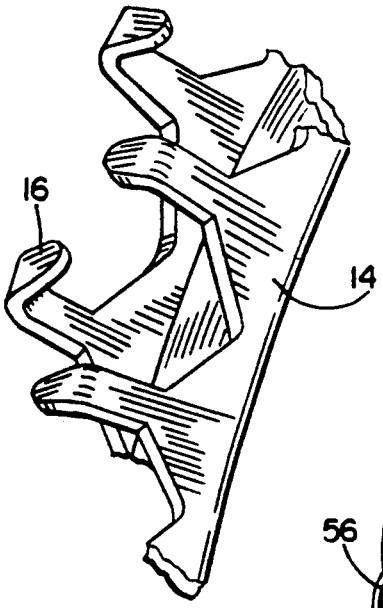
FIG. 15 is an enlarged fragmentary perspective view of a cinch ring in which a plurality of buff fingers according to the present invention are secured in circumferentially spaced relation to form a finger buff.
Figure 16:
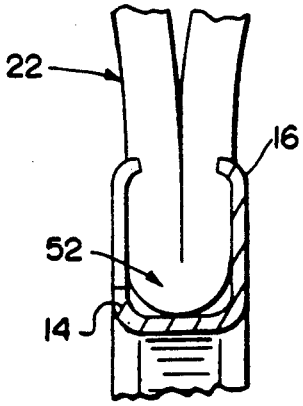
FIG. 16 is an enlarged fragmentary cross sectional view through a buff ring to show how buff fingers according to the present invention are secured in place.

A typical cinch ring 14 is shown in FIG. 15 in fragmentary perspective. As mentioned, the cinch ring 14 has a number of teeth 16 which are pinched together to grip the folded fingers 22 when they are inserted into the cinch ring. The cinch ring teeth 16 are staggered as indicated in FIG. 15. FIG. 16 illustrates how the teeth 16 grip the fingers 22 on opposite sides of fold 52.

Figure 17:
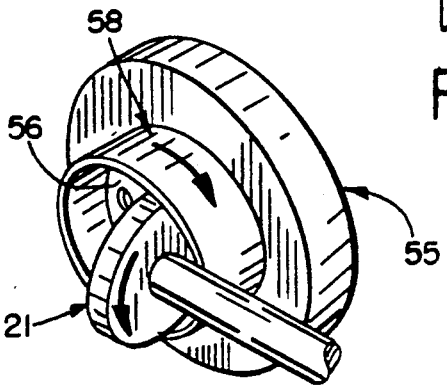
FIG. 17 is a schematic illustration showing how a finger buff according to the present invention may be used to buff an end face of a workpiece.
Figure 21:
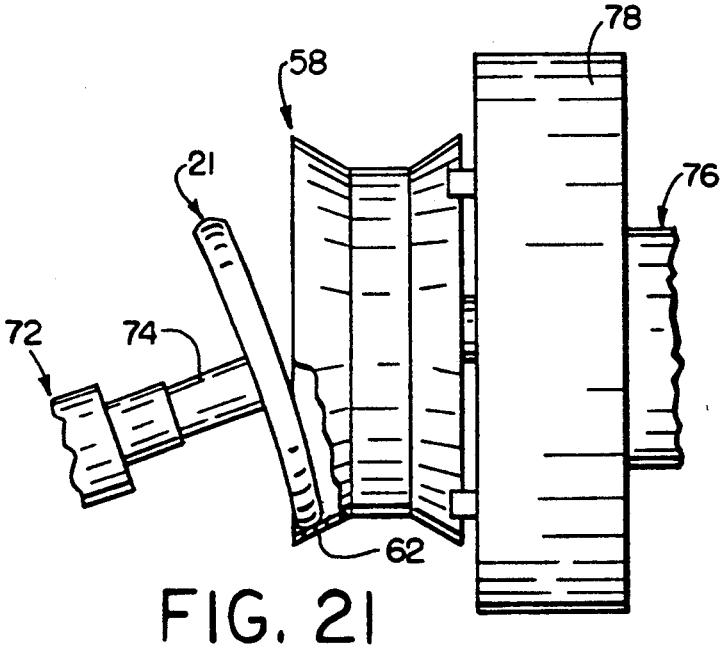
FIG. 21 is a schematic fragmentary side view showing how a finger buff according to the present invention may be used to buff the sides of a workpiece.

After the fingers 22 have been secured in the cinch ring 14 to complete the finger buff 21, one or more of such buffs 21 may be suitably mounted on the arbors of any of a number of machines for rotation therewith to buff various workpieces. During buffing of aluminum wheels for automobiles and trucks, for instance, a first machine 55 may be used to drive the buffs 21 and wheel to finish the face 56 of the wheel 58 as schematically shown in FIG. 17, and a second machine 60 used to drive the buffs 21 and wheel 58 to buff the wheel sides 62 as schematically shown in FIG. 21.

Figure 18:
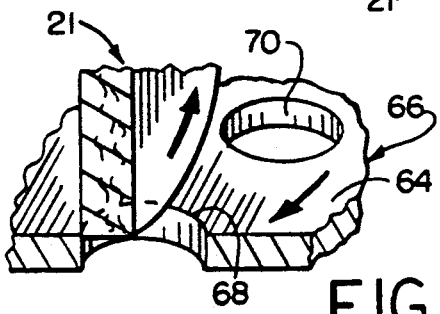
FIG. 18 is an enlarged fragmentary perspective schematic view showing a finger buff according to the present invention rotating against the direction of rotation of a workpiece to cut buff the workpiece in one direction and to remove burrs and sharp edges from one side of holes in the workpiece.
Figure 19:
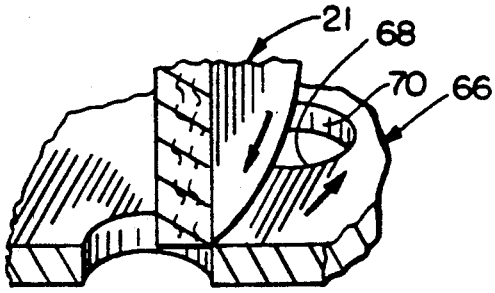
FIG. 19 is a perspective schematic view similar to FIG. 18 but showing the finger buff and workpiece direction of FIG. 18 reversed to remove sharp edges or burrs from the other side of holes in the workpiece.

In order to cut buff a workpiece, one or more buffs 21 rotating in one direction are placed against a surface 64 of a workpiece 66 which is rotating in the opposite direction so that the buffs are rotating against the motion of the workpiece. This type of buffing, which is best illustrated in FIG. 18, will also remove the sharp edges 68 from one side of decorative pockets or mounting holes 70, collectively referred to as recesses, which are commonly found in vehicle wheels, for instance. In this step of the buffing operation, medium to hard pressure is exerted by the buffs on the workpiece while applying a sharp or fast cutting buffing compound to smooth the surface and bring up as bright a finish as possible. Thereafter, the direction of rotation of both the buffs 21 and the workpiece 66 may be reversed as schematically shown in FIG. 19 so that burrs and sharp edges 68 may also be removed from the other side of the recesses 70 in the workpiece.

As in the initial buffing step, this further buffing step is one in which the buffs 21 and workpiece 66 are rotated in opposite directions with the buffs rotating against the motion of the workpiece. As will be apparent, this reversal of direction of both the buffs 21 and workpiece 66 may be accomplished in the same set up without having to reverse mount the buffs due to the fact that the buffs of the present invention may be rotated in either direction.

Figure 20:
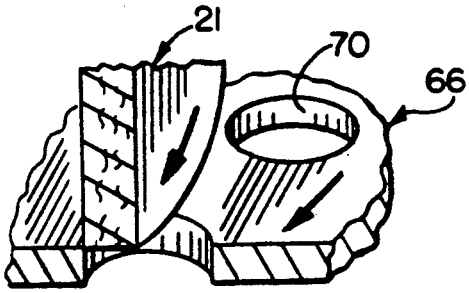
FIG. 20 is a schematic view similar to FIGS. 18 and 19 but showing the rotational direction of the finger buff of the present invention coinciding with that of the workpiece for color buffing the workpiece.

As a final step, and as illustrated in FIG. 20, a further buffing operation called "coloring" may be performed in which the direction of rotation of the workpiece 66 is the same as that of the buffs 21. During this buffing operation, a medium to light pressure between the buffs and workpiece is maintained while a milder buffing compound is applied to produce a higher or brighter finish on the workpiece.

In all cases the buffs 21 are desirably rotated at a relatively high speed, in the range of 1200 rpm. Also, an AC variable speed, variable frequency drive 72 (FIG. 21) is desirably employed to slow down the buff arbor 74 before changing the direction of rotation of the buff arbor and then slowly speed up. This slowing down of the buffs 21 before reversing direction of rotation also slows down the workpiece 58, 66 engaged thereby, thus allowing the use of a less expensive forward-reversing starter on the motor 76 used to drive the work table 78.

From the foregoing, it will now be apparent that the finger buffs of the present invention are non-directional buffs which may be used to both cut buff and color buff a workpiece in a single set up simply by reversing the direction of rotation of the buffs and/or workpiece. The cut edges of the buff finger material, being interiorly of the buff fingers, are not frayed regardless of the direction in which the buffs are rotated. Also, the utilization of less expensive forward-reversing starters for the work table is made possible because of the ability of the buffs to be slowed down and reversed in direction without having to disengage the buffs from the workpiece.

The buff fingers may be made of any suitable material such as 86-80 bias cut cotton which has been mill treated with 2% paraffin. The fingers may also be made in as many plies as desired, for example, sixteen plies, which results when four layers of the fabric material are twice folded over.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A non-directional buffing wheel comprising an annular support member and a plurality of circumferentially spaced buff fingers extending radially outwardly from said support member, each of said buff fingers comprising plural separate layers of material disposed on top of one another and folded as a unit intermediate buff finger ends, each of said buff fingers having a pair of radially extending side edges facing in opposite rotational directions of said wheel, each of said side edges being completely closed by single external folds of said material extending completely around said side edges, whereby said wheel may be driven in either of said opposite rotational directions to buff a workpiece.

2. The buffing wheel of claim 1 wherein each of said buff fingers has a pair of substantially flat, planar side faces extending between said pair of side edges.

3. The buffing wheel of claim 1 wherein said buff fingers are arranged in transversely facing pairs around the circumference of said support member, the buff fingers of each pair having inner sides facing toward each other and outer sides facing away from each other, said outer sides being substantially flat and planar and having continuous outer layers of said material.

4. The buffing wheel of claim 3 wherein said inner side of each of said buff fingers has two external folds linearly aligned and abutting each other to provide substantially flat, planar inner sides.

5. The buffing wheel of claim 1 wherein said buff fingers are arranged in pairs around the circumference of said support member, said buff fingers of each pair having outer planar sides facing away from each other, said outer planar sides having continuous outer layers of said material.

6. The buffing wheel of claim 5 wherein said buff fingers of each pair have inner sides facing toward each other which are substantially flat and planar.

7. The buffing wheel of claim 6 wherein each of said inner sides has a single interruption along the length of said inner sides formed by two oppositely facing external fabric folds which are linearly aligned and abut each other.

8. The buffing wheel of claim 7 wherein said plural layers of folded material have cut side edges all of which are located interiorly of said buff fingers.

9. The buffing wheel of claim 8 wherein said plural layers of folded material are secured together by plural longitudinal rows of stitching.

10. The buffing wheel of claim 9 wherein said cut side edges of said plural layers of folded material abut each other internally within said buff fingers, one of said external folds along the length of said inner side of each of said buff fingers overlying all of said cut side edges of said folded material, and there are at least two rows of said stitching extending through said one external fold adjacent opposite sides of said cut side edges from one side of each of said buff fingers to the other side.

11. A rotatable buff comprising plural pairs of buff fingers and annular support means for supporting said plural pairs of said buff fingers in circumferentially spaced relation around said annular support means, each of said buff fingers comprising plural separate plies of fabric disposed on top of one another and folded as a unit intermediate buff finger ends, each of said buff fingers having a pair of side edges facing in opposite rotational directions of said buff, each of said side edges being completely closed by single external folds of said fabric extending completely around said side edges, whereby said buff may be driven in either of said opposite rotational directions for buffing a workpiece.

12. The buff of claim 11 wherein each pair of said buff fingers have radial inner ends which are joined together.

13. The buff of claim 12 wherein said radial inner ends of said buff fingers of each pair are joined together by folds in said fabric.

* * * * *